US009304453B2

(12) United States Patent
Imahori et al.

(10) Patent No.: US 9,304,453 B2
(45) Date of Patent: Apr. 5, 2016

(54) IMAGE FORMING APPARATUS

(71) Applicant: FUJI XEROX CO., LTD., Minato-ku, Tokyo (JP)

(72) Inventors: Kazuki Imahori, Kanagawa (JP); Nobuyuki Sato, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 126 days.

(21) Appl. No.: 13/894,578

(22) Filed: May 15, 2013

(65) Prior Publication Data

US 2014/0126922 A1 May 8, 2014

(30) Foreign Application Priority Data

Nov. 2, 2012 (JP) ..... 2012-242886

(51) Int. Cl.
*G03G 15/20* (2006.01)

(52) U.S. Cl.
CPC ..... *G03G 15/2039* (2013.01)

(58) Field of Classification Search
CPC ..... G03G 15/5004; G03G 15/2039
USPC ..... 399/33, 44
See application file for complete search history.

(56) References Cited

U.S. PATENT DOCUMENTS

| | | | | |
|---|---|---|---|---|
| 4,538,902 | A * | 9/1985 | Inuzuka et al. | 399/33 |
| 2002/0114638 | A1 | 8/2002 | Kinoshita | |
| 2009/0322401 | A1 * | 12/2009 | Dixit | 327/332 |

FOREIGN PATENT DOCUMENTS

| | | | |
|---|---|---|---|
| JP | 57-092364 | A | 6/1982 |
| JP | 03-148715 | A | 6/1991 |
| JP | 09-185285 | A | 7/1997 |
| JP | 2002-246149 | A | 8/2002 |
| JP | 2006-058510 | A | 3/2006 |

OTHER PUBLICATIONS

Misumi. Machine Translation of JP2006058510. Published Mar. 2006. Translated Dec. 2014.*

Communication dated Dec. 22, 2015 from the Japanese Patent Office in counterpart Japanese application No. 2012-242886.

* cited by examiner

*Primary Examiner* — Ryan Walsh
*Assistant Examiner* — Philip Marcus T Fadul
(74) *Attorney, Agent, or Firm* — Sughrue Mion, PLLC

(57) ABSTRACT

An image forming apparatus includes a heating element that generates heat, a temperature detector that detects a temperature of the heating element, a resistor that divides a detection result of the temperature detector and a predetermined reference voltage, a disconnection detector that detects a disconnection of the temperature detector, a converter that converts the divided voltage value into a digital signal and outputs the digital signal to a controller, a comparing unit that inverts its output on the basis of a predetermined threshold, a delay circuit that delays an increase in an output voltage of the comparing unit, a discharge circuit that quickly discharges the output voltage of the comparing unit, a latch circuit connected to an output of the discharge circuit, and a power supply path connecting and disconnecting unit that is connected to the latch circuit and connects and disconnects a power supply path to the heating element.

10 Claims, 7 Drawing Sheets

IMAGE FORMING APPARATUS

CROSS-REFERENCE TO RELATED APPLICATIONS

This application is based on and claims priority under 35 USC 119 from Japanese Patent Application No. 2012-242886 filed Nov. 2, 2012.

BACKGROUND

Technical Field

The present invention relates to an image forming apparatus.

SUMMARY

According to an aspect of the invention, there is provided an image forming apparatus including a heating element that generates heat when a current is applied thereto, a temperature detector that is disposed in the vicinity of the heating element and detects a temperature of the heating element, a resistor that divides a detection result of the temperature detector and a predetermined reference voltage, a disconnection detector that is connected in parallel to the resistor, and detects a disconnection of the temperature detector, a converter that converts the divided voltage value into a digital signal and outputs the digital signal to a controller, a comparing unit that inverts an output thereof on the basis of a predetermined threshold, a delay circuit that delays an increase in an output voltage of the comparing unit, a discharge circuit that quickly discharges the output voltage of the comparing unit, a latch circuit that includes a flip-flop connected to an output of the discharge circuit, and a power supply path connecting and disconnecting unit that is connected to the latch circuit and connects and disconnects a power supply path to the heating element.

BRIEF DESCRIPTION OF THE DRAWINGS

An exemplary embodiment of the present invention will be described in detail based on the following figures, wherein.

DETAILED DESCRIPTION

Figure 1:
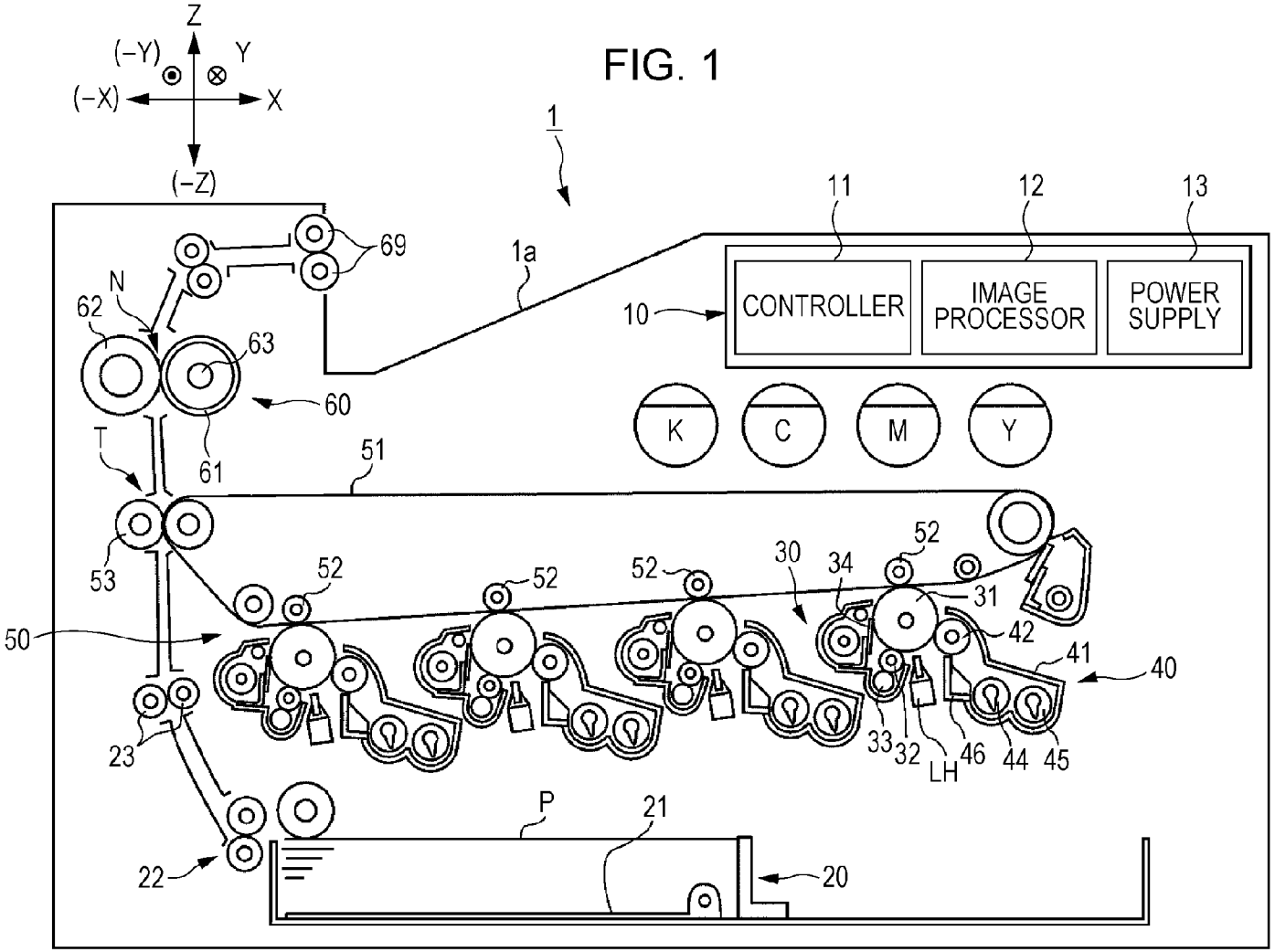
FIG. 1 is a schematic cross-sectional diagram illustrating the internal structure of an image forming apparatus.

Hereinafter, the present invention will be described in detail on the basis of an exemplary embodiment and specific examples, with reference to the accompanying drawings.

However, the present invention is not limited to the exemplary embodiment and specific examples described below.

Further, in the following description made with reference to the attached drawings, the drawings are schematic and not to scale, and some details are omitted for clarity.

For ease of explanation, in the drawings, the front and rear direction is referred to as an X-axis direction, the horizontal direction is referred to as a Y-axis direction; and the vertical direction is referred to as a Z-axis direction.

(1) Overall Configuration and Operation of Image Forming Apparatus

FIG. 1 is a schematic cross-sectional view illustrating the internal configuration of an image forming apparatus 1 according to the present exemplary embodiment.

In the following, the overall configuration and operation of the image forming apparatus 1 will be described with reference to the drawings.

The image forming apparatus 1 includes a control device 10, a sheet feeder 20, photoconductor units 30, developing devices 40, a transfer device 50, and a fixing device 60. A discharge tray 1*a* is formed on the upper surface (Z direction) of the image forming apparatus 1. Sheets with images printed thereon are discharged and stacked onto the discharge tray 1*a*.

The control device 10 includes a controller 11 that controls operations of the image forming apparatus 1, an image processor 12 whose operations are controlled by the controller 11, and a power supply 13. The power supply 13 applies voltage to a charging roller 32, a developing roller 42, first transfer rollers 52, a second transfer roller 53, and the like, which will be described below.

The image processor 12 converts print information, which is input from an external information transmitting apparatus (for example, personal computer), into image information for latent image formation, and outputs a drive signal to an exposure device LH at a predetermined timing. The exposure device LH of the present exemplary embodiment includes a light emitting diode (LED) head in which LEDs are linearly arranged.

The sheet feeder 20 is disposed at the bottom of the image forming apparatus 1. The sheet feeder 20 includes a sheet stacking plate 21. A large number of sheets P serving as recording media may be stacked on the upper surface of the sheet stacking plate 21. The sheets P stacked on the sheet stacking plate 21 and positioned in the width direction by a regulating plate (not illustrated) are drawn forward (−X direction) one by one from the top by a sheet drawing unit 22, and then are transported to a nip part of a registration roller pair 23.

The photoconductor units 30 are aligned at the upper side (Z direction) of the sheet feeder 20. Each photoconductor unit 30 includes a photoconductor drum 31 serving as a rotating image carrier. In the rotational direction of the photoconductor drum 31, the charging roller 32, the exposure device LH, the developing device 40, the first transfer roller 52, and a cleaning blade 34 are arranged. A cleaning roller 33 for cleaning the surface of the charging roller 32 is arranged so as to face and come into contact with the charging roller 32.

Each developing device 40 includes a developing housing 41 in which developer is stored. The developing roller 42 and a pair of augers 44 and 45 are disposed in the developing housing 41. The developing roller 42 is arranged so as to face the photoconductor drum 31. The pair of augers 44 and 45 are arranged obliquely below the rear surface of the developing roller 42 and are configured to agitate and transport the developer toward the developing roller 42. A layer regulating member 46 for regulating the thickness of the developer is arranged near the developing roller 42.

The developing devices 40 have the same configuration except for developers stored in the developing housings 41, and form toner images of yellow (Y), magenta (M), cyan (C), and black (K), respectively.

The surface of the rotating photoconductor drum 31 is charged by the charging roller 32, and an electrostatic latent image is formed thereon by a latent image-forming light emitted from the exposure device LH. The electrostatic latent image formed on the photoconductor drum 31 is developed into a toner image by the developing roller 42.

The transfer device 50 includes an intermediate transfer belt 51 onto which the toner images of the respective colors formed on the photoconductor drums 31 of the respective photoconductor units 30 are transferred and superimposed, and the first transfer rollers 52 that sequentially transfer (first transfer) the toner images of the respective colors formed by the respective photoconductor units 30 onto the intermediate transfer belt 51. The transfer device 50 further includes the second transfer roller 53 that transfers (second transfer) the toner images of the respective colors, which have been transferred and superimposed on the intermediate transfer belt 51, all at once onto the sheet P serving as a recording medium.

The toner images of the respective colors formed on the photoconductor drums 31 of the photoconductor units 30 are sequentially transferred (first transfer) onto the intermediate transfer belt 51 by the first transfer rollers 52 to which a predetermined transfer voltage applied from the power supply 13 or the like controlled by the controller 11. Thus, superimposed toner images of superimposed toner of the respective colors are formed.

The superimposed toner images on the intermediate transfer belt 51 are transported by the movement of the intermediate transfer belt 51 to a region (second transfer section T) in which the second transfer roller 53 is arranged. When the superimposed toner images are transported to the second transfer section T, a sheet P is supplied to the second transfer section T from the sheet feeder 20 in accordance with that timing. Then, a predetermined transfer voltage is applied to the second transfer roller 53 from the power supply 13 or the like controlled by the controller 11, so that the superimposed toner images on the intermediate transfer belt 51 are transferred all at once onto the sheet P that is transported by the registration roller pair 23 and guided by transport guides.

The toner remaining on the surface of the photoconductor drum 31 is removed by the cleaning blade 34, and is collected into a waste developer container. The surface of the photoreceptor drum 31 is charged again by the charging roller 32. The residual toner that is not removed by the cleaning blade 34 and adhering to the charging roller 32 is removed and collected onto the surface of the cleaning roller 33 that rotates in contact with the charging roller 32.

The fixing device 60 includes a fixing roller 61 and a pressure roller 62. A pressure contact region between the fixing roller 61 and the pressure roller 62 defines a nip part N (fixing region).

The sheet P to which the toner image is transferred by the transfer device 50 is transported, with the toner image not fixed thereon, to the fixing device 60 through transport guides. When the sheet P is transported to the fixing device 60, the toner image is fixed by a pair of the fixing roller 61 and the pressure roller 62 through the action of pressure and heat.

The sheet P on which a fixed toner image is formed is guided by transport guides, and is discharged by a discharge roller pair 69 onto the discharge tray 1*a* on the upper surface of the image forming apparatus 1.

Figure 2:
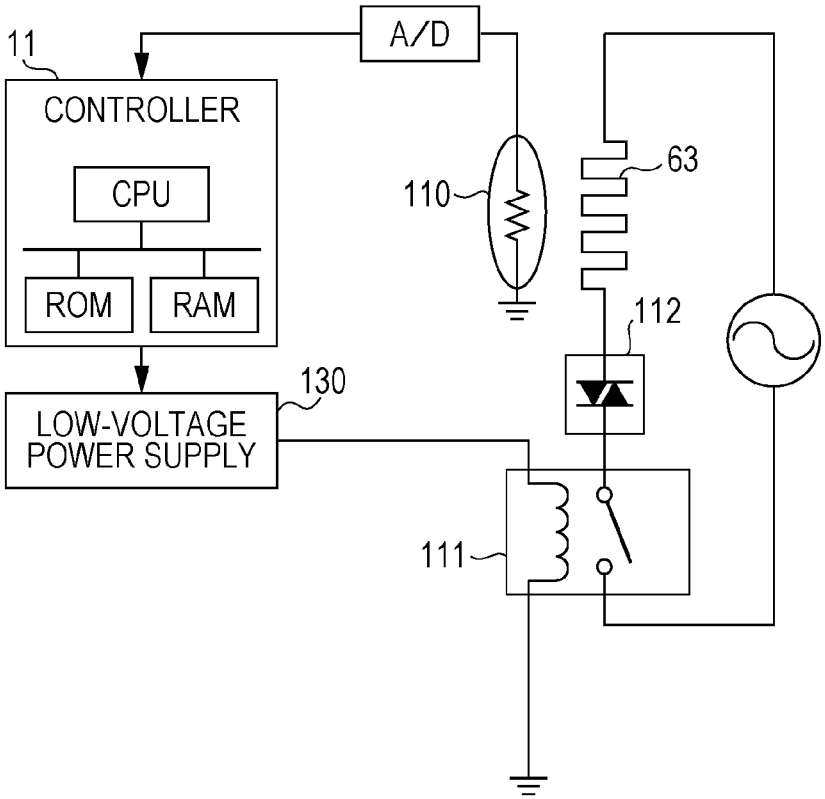
FIG. 2 is a block diagram illustrating the functional configuration of the image forming apparatus.

(2) Configuration and Temperature Control Circuit Configuration of Fixing Device FIG. 2 is a block diagram illustrating the functional configuration of the image forming apparatus 1.

In the following, the configuration of the fixing device 60 and control operations in a fixing process will be described with reference to the drawings.

(2.1) Schematic Configuration of Fixing Lamp Turn-On Control of Fixing Device

The fixing roller 61 of the fixing device 60 includes a fixing lamp 63 as an example of a heating element. The fixing roller 61 is heated by heat generated when the fixing lamp 63 is turned on.

The fixing lamp 63 of the fixing device 60 is controlled by a fixing controller 101 that forms a part of the controller 11, and by a low-voltage power supply 130 that forms a part of the power supply 13.

The thermistor 110 as an example of a temperature detector detects the temperature of the fixing roller 61, and outputs a temperature signal Vs corresponding to the detected temperature to the controller 11.

A fixing relay 111 as an example of a power supply path connecting and disconnecting unit is a switch element that operates with a driving voltage supplied from the low-voltage power supply 130, and allows or interrupts the power supply from an alternating-current (AC) power supply (not illustrated) to the fixing lamp 63.

Examples of the fixing relay 111 may include a solid state relay, a triac, and other types of switch elements.

The controller 11 turns on the fixing lamp 63 through the switch element 112 in accordance with the temperature signal Vs that is input from the thermistor 110, and thereby controls the surface temperature of the fixing roller 61 to a temperature suitable for fixing.

More specifically, if the temperature calculated from the temperature signal Vs is equal to or lower than a preset target temperature Tl (see FIG. 5), the controller 11 closes the switch element 112 such that power is supplied to the fixing lamp 63 from the AC power supply. If the temperature calculated from the temperature signal Vs is higher than a preset target temperature Tu, the controller 11 opens the switch element 112 so as to interrupt application of current to the fixing lamp 63.

(2.2) Overview of Temperature Management Control of Fixing Lamp

Figure 5:
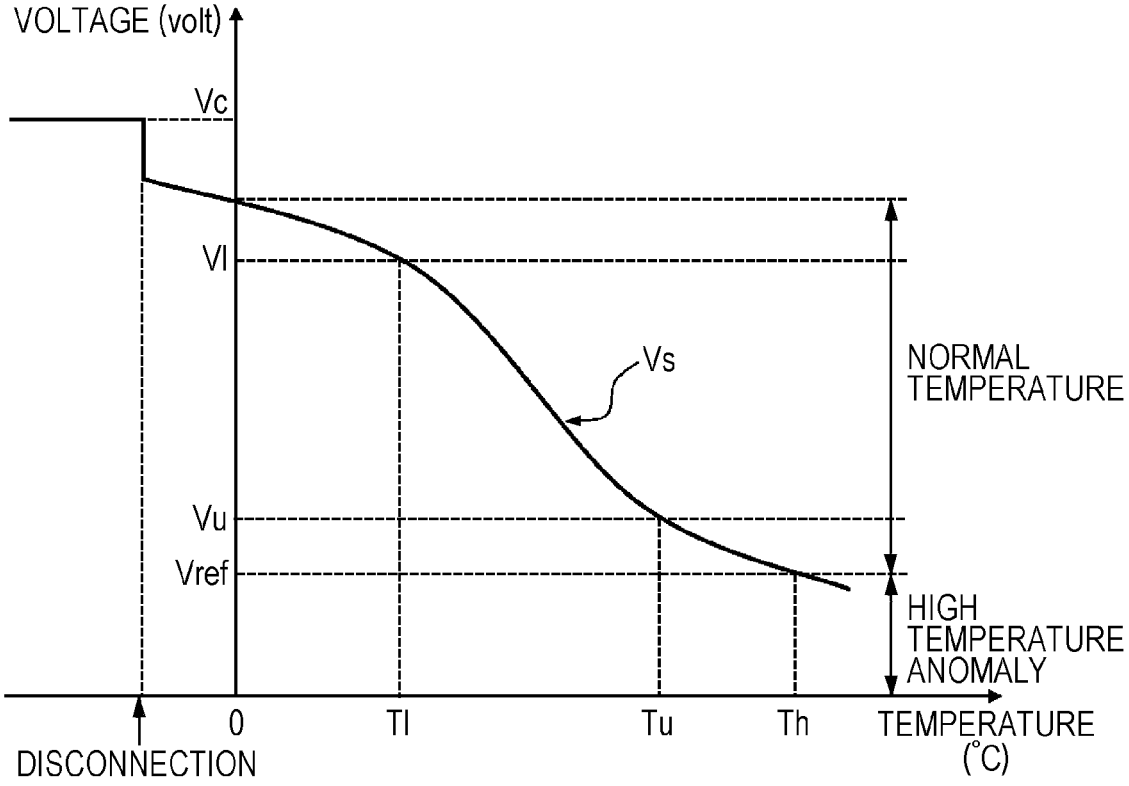
FIG. 5 is a graph illustrating the relationship between a temperature signal and the temperature in the vicinity of a fixing roller.

FIG. 5 is a graph illustrating the relationship between the temperature signal Vs output by the thermistor 110 and the temperature in the vicinity of the fixing roller 61.

As illustrated in FIG. 5, the temperature signal Vs monotonically decreases as the temperature in the vicinity of the fixing roller 61 increases, and monotonically increases as the temperature in the vicinity of the fixing roller 61 decreases. If the temperature signal Vs is greater than a predetermined threshold value Vl (if the temperature is lower than the target temperature Tl), the fixing roller 61 is heated (a current is applied to the fixing lamp 63). Thus, the temperature increases, and the temperature signal Vs decreases.

On the other hand, if the temperature signal Vs is less than the predetermined threshold value Vu (if the temperature is higher than the target temperature Tu), the application of current to the fixing lamp 63 is interrupted. Thus, the temperature of the fixing roller 61 decreases, and the temperature signal Vs increases.

Further, the controller 11 constantly determines whether the temperature of the fixing roller 61 is normal or abnormal. More specifically, the controller 11 compares the temperature of the fixing roller 61 with a temperature threshold so as to determine overheating of the fixing roller 61 (fixing lamp 63).

For example, if the temperature signal Vs falls below a threshold Vref, that is, if the temperature in the vicinity of the fixing roller 61 exceeds the threshold temperature Th, the fixing relay 111 interrupts application of current to the fixing lamp 63.

In the case where the thermistor 110 is disconnected, the temperature signal Vs exceeds the threshold Vref to reach, for example, a reference voltage (3.3 volts). In order to prevent the fixing lamp 63 from being turned on and overheated under these conditions, the fixing relay 111 interrupts application of current to the fixing lamp 63.

On the other hand, even if the thermistor 110 is connected normally, when the temperature is low, for example, around 0° C., the resistance of the thermistor 110 is increased. Thus, the temperature signal Vs approaches the reference voltage (3.3 volts), which may result in a false detection.

Accordingly, in order to distinguish an increase in the temperature signal Vs due to an increase in resistance from a disconnected state, another thermistor dedicated to disconnection detection may be provided that has temperature characteristics configured for disconnection detection.

In the following, fixing-lamp-temperature monitoring control in the image forming apparatus 1 according to the present exemplary embodiment will be described with reference to the drawings. First, problems with an image forming apparatus 100 of Comparative Example 1 and an image forming apparatus 200 of Comparative Example 2 will be described with reference to the drawings.

In the following description, elements common to the respective developing devices are denoted by the same reference numerals, and the detailed description thereof will be omitted.

Comparative Example 1

Figure 6:
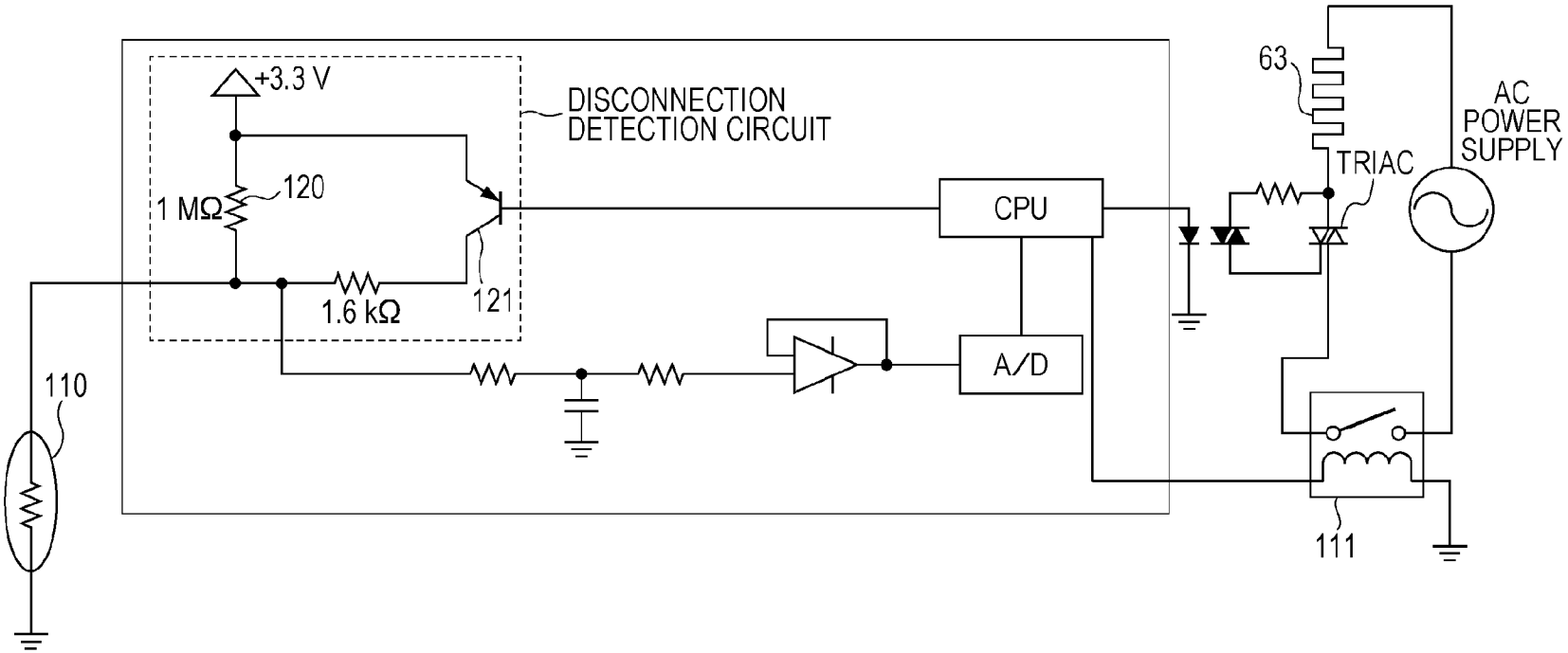
FIG. 6 is a diagram illustrating a circuit configuration for fixing-lamp-temperature monitoring control according to Comparative Example 1.

FIG. 6 is a diagram illustrating a circuit configuration for monitoring the temperature of a fixing lamp of a fixing unit in an image forming apparatus 100 of Comparative Example 1.

A pull-up resistor 120 as an example of a resistor that divides a temperature signal Vs of a thermistor 110 and a reference voltage is provided in parallel, and the ON/OFF operation is performed by a transistor 121 serving as a switching element. Thus, the temperature signals Vs for disconnection detection and temperature control are shifted to one another.

The temperature signal Vs is appropriately converted from analog into digital and is input to the CPU of a controller 11. The detected analog value is compared to a predetermined threshold so as to determine a disconnection, and application of current to a fixing lamp 63 is interrupted.

As for high temperature detection, a fixing relay 111 interrupts application of current to the fixing lamp 63 when the detected analog value reaches a predetermined threshold voltage.

With this method, however, in the case where the program executed on the CPU runs away, it is not possible to perform normal control operations.

Comparative Example 2

Figure 7:
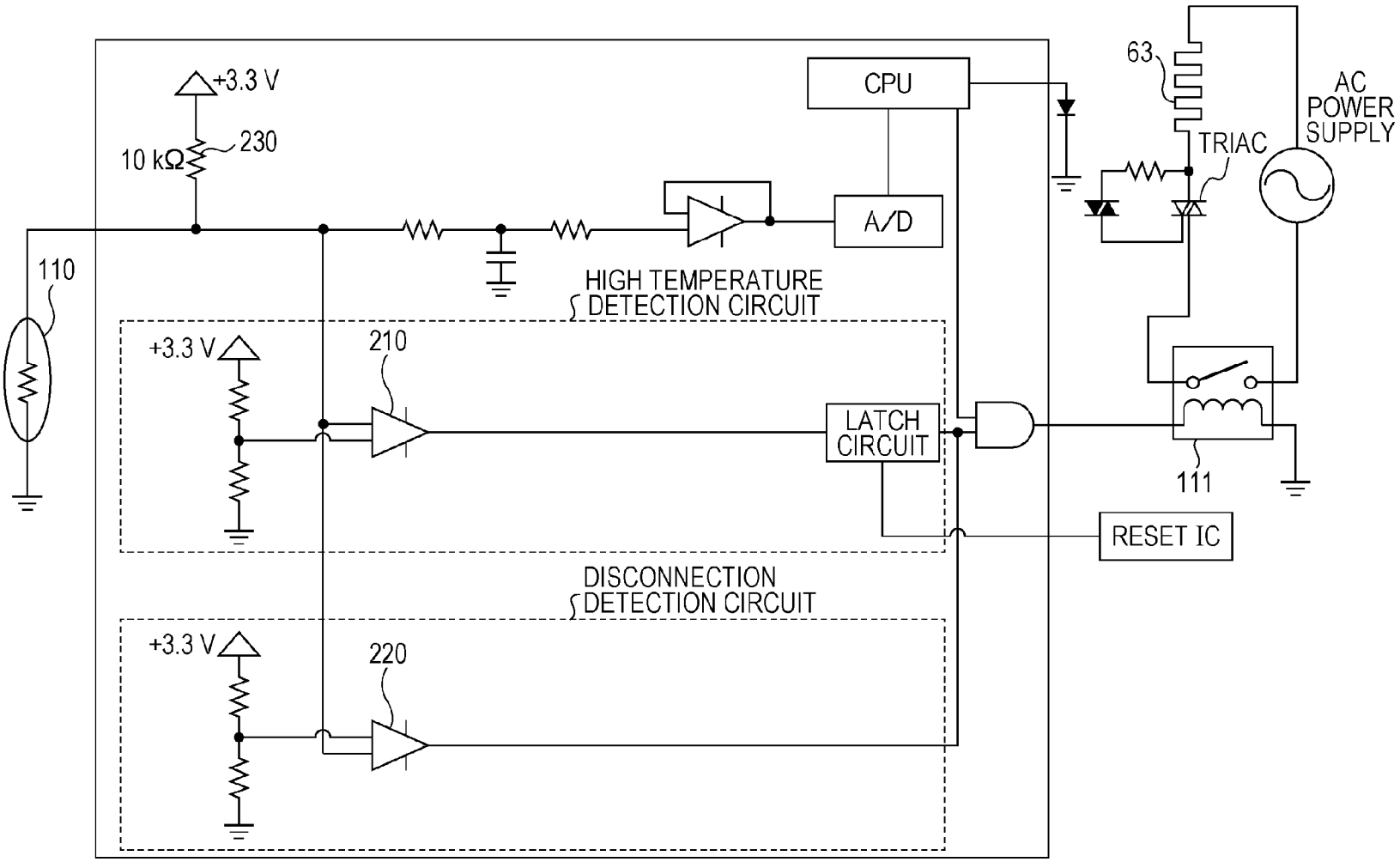
FIG. 7 is a diagram illustrating a circuit configuration for fixing-lamp-temperature monitoring control according to Comparative Example 2.

FIG. 7 is a diagram illustrating a circuit configuration for monitoring the temperature of a fixing lamp of a fixing unit in the image forming apparatus 200 of Comparative Example 2.

The image forming apparatus 200 includes a comparator 210 that determines overheating of a fixing roller 61 (fixing lamp 63), and a comparator 220 that determines a disconnection of a thermistor 110. The image forming apparatus 200 interrupts application of current to the fixing lamp 63 on the basis of a temperature signal Vs of the thermistor 110 that is divided by a pull-up resistor 230.

On the other hand, since the comparator 220 performs disconnection detection, a thermistor for disconnection detection is used that have temperature characteristics configured specifically for disconnection detection, in addition to a thermistor for temperature control. This results in an increase in cost.

(2.3) Circuit for Monitoring Temperature of Fixing Lamp

Figure 3:
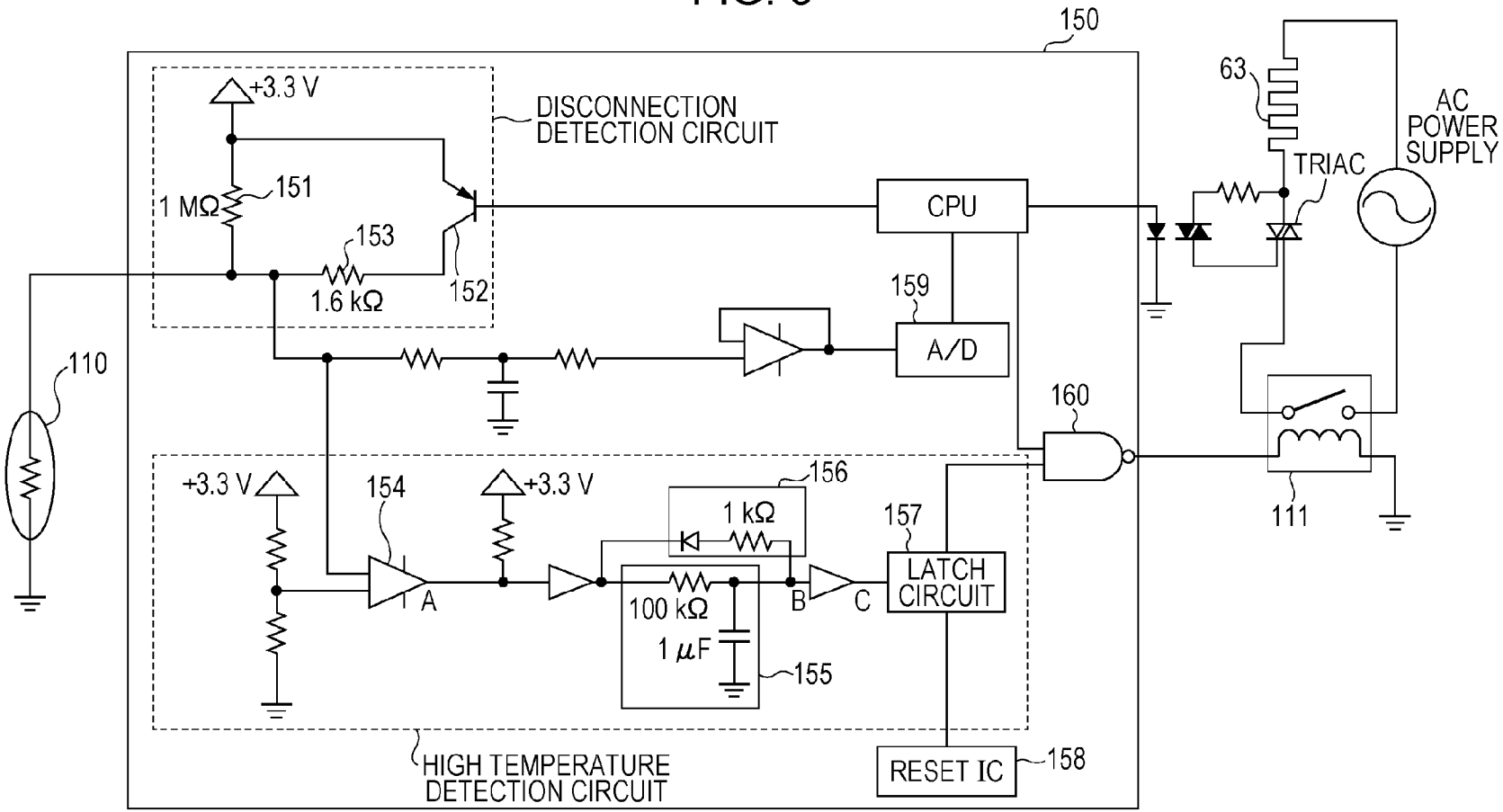
FIG. 3 is a diagram illustrating a circuit configuration for fixing-lamp-temperature monitoring control of a fixing device.

FIG. 3 is a diagram illustrating a circuit configuration for fixing-lamp-temperature monitoring of the fixing device 60 in the image forming apparatus 1 according to the present exemplary embodiment.

As illustrated in FIG. 3, a fixing-lamp-temperature monitoring circuit 150 includes a disconnection detecting unit and a high temperature detecting unit.

The disconnection detecting unit includes a pull-up resistor 151 that divides a temperature signal Vs transmitted from the thermistor 110, which detects the temperature of the fixing roller 61 (fixing lamp 63), and a reference voltage (3.3 volts), and a transistor 152 and a resistor 153 that are connected in parallel to the pull-up resistor 151 and detect a disconnection of the thermistor 110.

The high temperature detecting unit includes a comparator 154 as an example of a comparing unit that operates when the divided temperature signal Vs which is input thereto reaches a predetermined threshold, a delay circuit 155 that delays an increase in the output voltage from the comparator 154, a discharge circuit 156 that quickly discharges the output voltage, a latch circuit 157 that transmits a latch signal which remains as an abnormal signal when an abnormal signal is output from the comparator 154.

It is to be noted that, in the case where an abnormal latch state is held by the latch circuit 157, this abnormal latch state is released by a latch release circuit 158.

An AD converter 159 is an example of a converter that converts the divided temperature signal Vs from analog into digital and outputs the conversion result to the CPU. When the port of the disconnection detecting unit becomes high (H) level, a temperature detection value of the thermistor 110 is input to an AD input part of the AD converter 159, and a disconnection detection value is input when the port becomes low (L) level.

Further, the comparator 154 is connected to the AD input part of the AD converter 159, and a threshold to be set is determined in accordance with the temperature characteristics of the thermistor 110 in use.

The output from the latch circuit 157 of the high temperature detecting unit is input to one of input terminals of a NAND circuit 160. The output from the CPU is input to the other input terminal of the NAND circuit 160. The output of the NAND circuit 160 is determined on the basis of a logical AND of these two input values. The fixing relay 111 allows or interrupts the power supply from the AC power supply to the fixing lamp 63.

(3) Operation

Figure 4:
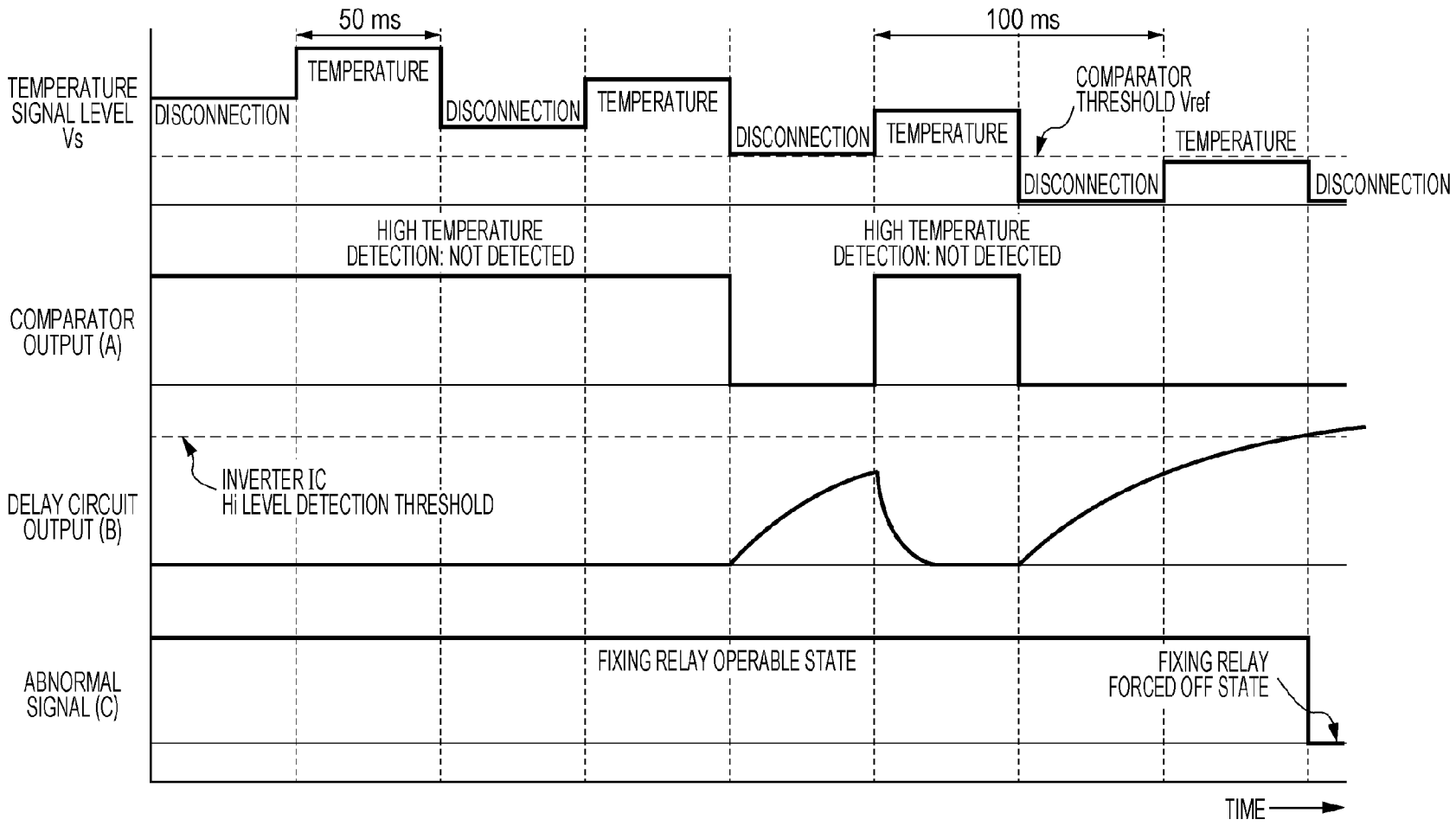
FIG. 4 is a time chart of fixing-lamp-temperature monitoring control of a fixing device.

FIG. 4 is a time chart of an exemplary operation of fixing-lamp-temperature monitoring control of the fixing device 60 in the image forming apparatus 1 according to the present exemplary embodiment.

Hereinafter, operations of the present exemplary embodiment will be described.

FIG. 4 schematically illustrates the state of the temperature signal Vs that is output from the thermistor 110 and is input to the fixing-lamp-temperature monitoring circuit 150 over time, the output value of the comparator 154 in the high temperature detecting unit, the output value of the delay circuit 155, and the state of the abnormal signal that is input to the latch circuit 157, in accordance with the lapse of time.

In the present exemplary embodiment, a time constant CR of the delay circuit 155 connected to an output part of the comparator 154 of the high temperature detecting unit is set so as not to affect temperature control of the fixing device 60.

More specifically, the time constant CR is determined by taking into consideration of self-heating due to supply of electrical current to the thermistor 110 in a low-resistance region, the maximum time until the fixing device 60 emits smoke in the event of runaway of a program executed on the CPU, false detection, and the like, and is set in the range from 100 ms to 500 ms.

In the case where a disconnection detection voltage value and a temperature detection voltage value are alternately switched and acquired every 50 ms, and the time constant CR of the delay circuit 155 is set to 200 ms, under low temperature conditions, although the disconnection detection voltage value and the temperature detection voltage value are alternately switched every 50 ms, since the voltage values do not reach a threshold voltage of the comparator 154 of the high temperature detecting unit. Thus, normal operations are carried out.

When the fixing lamp 63 is turned on and the temperature in the vicinity of the fixing roller 61 gradually increases, both the disconnection detection voltage value and the temperature detection voltage value gradually decrease. Then, the voltage of the disconnection detection side reaches the preset threshold (Vref) that is preset in the comparator 154. However, the voltage of the disconnection detection side is switched at 50 ms to the temperature detection voltage, which is out of the threshold (Vref) range. Thus, the output of the comparator 154 is inverted.

At this point, the latch circuit transmission to the fixing relay 111 is prevented due to the time constant CR of the delay circuit 155 connected to the output part of the comparator 154. Accordingly, the high temperature detection circuit does not operate.

Then, in the case where both the disconnection detection voltage value and the temperature detection voltage value decrease and actually reach a voltage value of high temperature detection, even when the disconnection detection voltage and the temperature detection voltage are switched therebetween at 50 ms, since both have reached the threshold (Vref) of the comparator 154, the latch circuit operates after a lapse of the time constant CR (200 ms) that is set in the delay circuit 155.

In the present exemplary embodiment, the threshold (Vref) of the comparator 154 is set to, for example, 0.7 volts at which the target temperature Tu in the vicinity of the fixing roller 61 becomes 250° C.

With use of the fixing-lamp-temperature monitoring circuit 150 according to the present exemplary embodiment, the fixing relay 111 may be operated while distinguishing between disconnection detection and high temperature detection without involving a control circuit of the CPU. Therefore, in the event of runaway of a program executed on the CPU, overheating of the fixing roller 61 (fixing lamp 63) may be reliably prevented.

Further, the delay circuit 155 is connected to the output part of the comparator 154. Therefore, even if the voltage of the disconnection detection side reaches a threshold (Vref) that is preset in the comparator 154, and thus the output of the comparator 154 is inverted, the latch circuit transmission to the fixing relay 111 is prevented due to the time constant CR of the delay circuit 155 connected to the output part of the comparator 154. Accordingly, the high temperature detection circuit does not operate.

Further, in the case where both the disconnection detection voltage value and the temperature detection voltage value decrease and actually reach a voltage value of high temperature detection, the latch circuit 157 operates after a lapse of the time constant CR (200 ms) that is set in the delay circuit 155.

Accordingly, temperature may be monitored without providing a thermistor dedicated to disconnection detection in addition to a thermistor for temperature detection. Thus, a temperature detection circuit may be realized at low costs.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

For example, in the present exemplary embodiment, a so-called "CR circuit" including a capacitor (C) and a resistor (R) has been illustrated as the delay circuit. However, the delay circuit is not limited thereto. For example, a reset IC including a delay circuit may be used as a delay circuit.

Further, the present invention is not limited to a fixing device of a heating type using a fixing lamp, such as a halogen lamp, as a heating element, but may be applied to a fixing device of an electromagnetic induction heating type.

What is claimed is:

1. An image forming apparatus comprising:

a heating element configured to generate heat when a current is applied thereto;

a temperature detector that is disposed in the vicinity of the heating element and is configured to detect a temperature of the heating element;

a resistor configured to divide a detection result of the temperature detector and a predetermined reference voltage;

a disconnection detector that is connected in parallel to the resistor, and is configured to detect a disconnection of the temperature detector;

a converter configured to convert the divided voltage value into a digital signal and to output the digital signal to a controller;

a comparing unit configured to invert an output of the comparing unit on the basis of a comparison between the divided voltage value and a predetermined threshold, and a comparison between an output of the disconnection detector and the predetermined threshold;

a delay circuit configured to delay an increase in an output voltage of the comparing unit;

a discharge circuit configured to quickly discharge the output voltage of the comparing unit;

a latch circuit that includes a flip-flop connected to an output of the discharge circuit; and a power supply path connecting and disconnecting unit that is connected to the latch circuit, and is configured to connect and disconnect a power supply path to the heating element.

2. The image forming apparatus according to claim 1, wherein a delay time of the delay circuit and the discharge circuit is greater than time taken to switch from temperature detection to disconnection detection.

3. The image forming apparatus according to claim 1, wherein the delay circuit and the discharge circuit include a capacitor and a resistor.

4. The image forming apparatus according to claim 1, wherein the delay circuit and the discharge circuit include a reset circuit.

5. The image forming apparatus according to claim 1, wherein:

the comparing unit is configured to compare an input, input to the comparing unit, to the predetermined threshold, to output a first output of a first level when the input is less than the predetermined threshold, and to output a second output of a second level when the input is greater than the predetermined threshold, and wherein the input is either of the divided voltage value and a disconnection detection voltage, corresponding to the detected disconnection by the disconnection detector.

6. The image forming apparatus according to claim 5, wherein the input to the comparing unit is repeatedly switched, at a predetermined time interval, between the divided voltage value and the disconnection detection voltage.

7. The image forming apparatus according to claim 6, wherein a delay time of the delay circuit and the discharge circuit is greater than the predetermined time interval.

8. The image forming apparatus according to claim 6, wherein the delay time of the delay circuit and the discharge circuit is greater than the predetermined time interval such that:

when the disconnection detection voltage is less than the predetermined threshold and the divided voltage value is greater than the predetermined threshold, the latch circuit does not operate to control the power supply path connecting and disconnecting unit to disconnect the power supply path to the heating element; and when the disconnection detection voltage is less than the predetermined threshold and the divided voltage value is less than the predetermined threshold, the latch circuit operates to control the power supply path connecting and disconnecting unit to disconnect the power supply path to the heating element.

9. The image forming apparatus according to claim 1, wherein the disconnection detector comprises a transistor and a resistor.

10. The image forming apparatus according to claim 1, wherein the power supply path connecting and disconnecting unit is configured to connect and disconnect the power supply path to the heating element according to a signal from the latch circuit.

* * * * *